US007867338B1

(12) United States Patent
Salvant

(10) Patent No.: US 7,867,338 B1
(45) Date of Patent: Jan. 11, 2011

(54) ROOF CLEANING METHOD

(76) Inventor: Thomas A. Salvant, 125 Louise Dr., Mandeville, LA (US) 70448

( * ) Notice: Subject to any disclaimer, the term of this patent is extended or adjusted under 35 U.S.C. 154(b) by 1063 days.

(21) Appl. No.: 11/251,325

(22) Filed: Oct. 13, 2005

(51) Int. Cl.
*B08B 1/00* (2006.01)

(52) U.S. Cl. ..... 134/6; 134/42; 15/104.001; 15/106; 15/159.1; 15/160

(58) Field of Classification Search ..... 134/6, 134/42; 441/81; 446/34, 46; 15/159.1, 104.001, 15/160, 23, 24, 50.3, 103, 106
See application file for complete search history.

(56) References Cited

U.S. PATENT DOCUMENTS

| | | | | | |
|---|---|---|---|---|---|
| 2,814,815 | A | * | 12/1957 | Johnson | 401/14 |
| 2,817,867 | A | | 12/1957 | Bugbird | |
| 2,896,239 | A | | 7/1959 | Bugbird | |
| 2,943,892 | A | * | 7/1960 | Hessler et al. | 403/58 |
| 3,773,375 | A | | 11/1973 | Nehls | |
| 4,024,654 | A | * | 5/1977 | Snyder | 37/268 |
| 4,028,769 | A | | 6/1977 | Coviello et al. | |
| 4,095,746 | A | | 6/1978 | Anderberg et al. | |
| 4,249,767 | A | | 2/1981 | Andreasen | |
| 4,319,851 | A | | 3/1982 | Arthur | |
| 4,422,202 | A | * | 12/1983 | Malvasio | 15/106 |
| 4,554,699 | A | * | 11/1985 | Simmons | 15/201 |
| 4,657,597 | A | | 4/1987 | Wolf et al. | |
| 4,759,658 | A | | 7/1988 | Manor | |
| 4,817,232 | A | | 4/1989 | Bardunias | |
| 4,978,241 | A | | 12/1990 | Lawson | |
| 5,483,725 | A | | 1/1996 | Lehman | |
| 5,653,392 | A | | 8/1997 | Wells | |
| 5,853,209 | A | | 12/1998 | McDermott | |
| 6,119,311 | A | | 9/2000 | Lavallee | |
| 6,709,529 | B1 | * | 3/2004 | Mekwinski | 134/6 |
| 2002/0148061 | A1 | * | 10/2002 | Tanaka et al. | 15/229.3 |
| 2002/0190145 | A1 | | 12/2002 | Sheppard, Jr. | |

FOREIGN PATENT DOCUMENTS

| | | |
|---|---|---|
| WO | WO9324717 | 12/1993 |

* cited by examiner

*Primary Examiner*—Michael Kornakov
*Assistant Examiner*—Ryan Coleman
(74) *Attorney, Agent, or Firm*—Garvey, Smith, Nehrbass & North, L.L.C.; Brett A. North

(57) ABSTRACT

A roof brush and method of use. What is provided is a brush head which can be tossed on a roof and subsequently pulled off the roof to remove leaves and other debris on the roof. Accordingly, a roof brush is provided which is capable of cleaning a roof and permitting an individual operating the roof brush to remain standing on the ground while cleaning.

20 Claims, 4 Drawing Sheets

ROOF CLEANING METHOD

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND

This invention relates to apparatus and methods for cleaning buildings, and in particular to a method and apparatus for cleaning roofs.

A cleaning problem associated with roofs is the accumulation of leaves and twigs that builds up from surrounding trees and large plants over time. Surrounding trees tend to drop their leaves, berries, twigs, and other debris onto the roofs, and the result is a load of tree trash accumulated on the roof. The problem then becomes removing this debris and is especially pronounced in the case of large pitched and high roofs which are dangerous to access. Large pitched and high roofs are difficult and dangerous to access and walk upon.

One cleaning method which has been attempted is using a hose to blast the vegetation off roofs from the ground. Unfortunately, this approach has the effect of turning the accumulated vegetable matter into a soggy mess, considerably heavier than the dry mess we started out with. Once the accumulated vegetable matter is wet, it becomes even more difficult to remove than when dry.

A number of patents have been granted for articulated brooms and other cleaning devices capable of cleaning hard-to-reach places. U.S. Pat. Nos. 2,817,867 and 2,896,239 were granted to Mr. Bugbird for gutter cleaning devices. While these patents taught a brush and a broom respectively held to a handle, the angle between the broom or brush and the handle was only adjustable from the ground, and thus these devices were not suitable for cleaning wide expanses of roofs.

U.S. Pat. Nos. 6,119,311, 5,853,209 and 3,773,375 were granted Lavallee, McDermott, and Nehls respectively. While these patents taught a brush or other cleaning device hingedly attached to a handle, they all taught methods of use where the angle between the brush and the handle was set on the ground, and was not adjustable during use. For this reason, it would be difficult to keep the brush in contact with the roof to be cleaned.

Thus, it would be desirable to provide a roof cleaning brush which could have an angle between its brush and its handle adjustable during use. This feature would enable the brush to remain in contact with a roof being cleaned by virtue of gravity pushing the brush down onto the roof being cleaned.

It would also be desirable to have a brush which conforms to the shape of the roof being cleaned.

It would also be desirable to have a brush which can be easily placed on the top of the roof.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. What is provided is a brush head which can be tossed on a roof and subsequently pulled off the roof to remove leaves and other debris on the roof Accordingly, in one embodiment is provided a roof brush which is capable of cleaning a roof and permitting an individual operating the roof brush to remain standing on the ground while cleaning.

In one embodiment is provided a roof brush permitting a cleaning head to be pulled all the way to the edge of a roof being cleaned, so that debris on the screen roof can be brushed off the roof.

In one embodiment is provided a roof brush which is capable of cleaning a roof with a liquid solution while brushing the roof. An advantage associated with this embodiment include better quality cleaning of the roof.

In one embodiment is provided a roof brush which can be easily thrown into position on a roof to be cleaned. Benefits associated with this embodiment include time saved positioning the cleaning head and elimination of the necessity of using a ladder to position the cleaning head.

In one embodiment is provided a roof brush whose design is optimized to remove organic debris from roofs. Advantages associated with this embodiment include more efficient roof cleaning, along with the attendant cost and time savings.

In one embodiment is provided a roof brush method of use which provides safe and easy roof cleaning. Benefits associated with this embodiment include safety and efficiency.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 1:
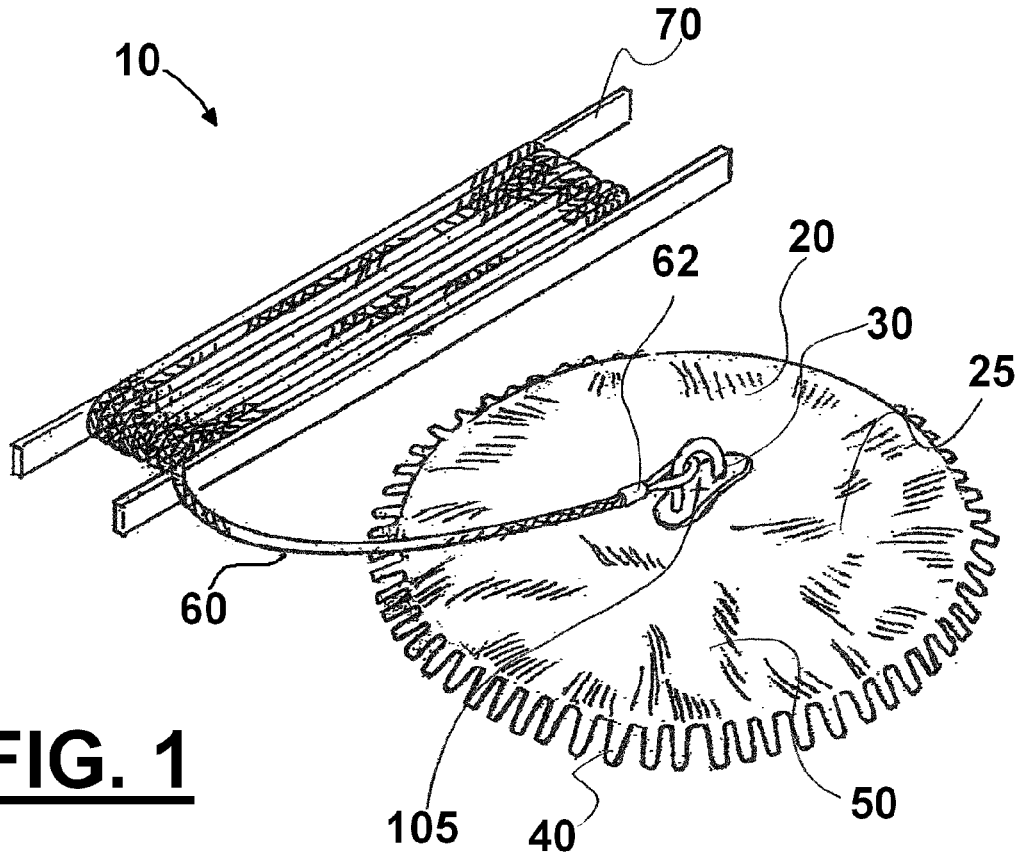
FIG. 1 is a perspective view of one embodiment of the roof cleaning brush showing the top of the brush head.
Figure 2:
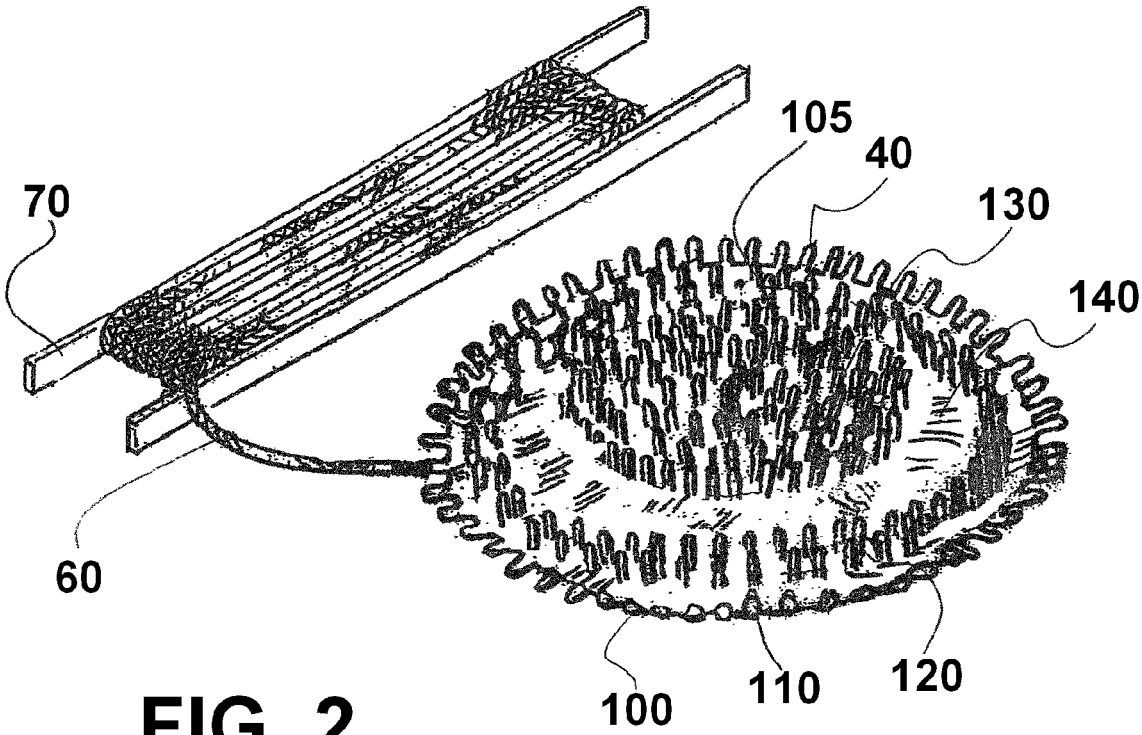
FIG. 2 is a perspective view of the roof cleaning brush of FIG. 1 showing the bottom of the brush head.

FIG. 1 is a perspective view of one embodiment of the roof cleaning brush apparatus 10 showing top 50 of brush head 20. FIG. 2 is a perspective view of cleaning brush apparatus 10 showing bottom 100 of brush head 20. Cleaning brush apparatus 10 can include brush head 20 and line 60. Brush head 20 can include circular base 25. Circular base can include a plurality of projections, fingers, or bristles 40.

Brush head 20 can be made out of an material sufficient to stand up to the stresses and wear and tear during use. Preferably, brush head 20 comprises a strong flexible material such as rubber, silicone, polymer, plastic, straw, cloth, etc. The material for brush head should be selected based on both flight characteristics (where brush head 20 will be used as a FRISBEE® type flying saucer) and weight characteristics (where brush head 20 will be used to push/scrape off debris from roof). The size and weight of brush head 20 can be selected for different throwing distances and coverage area when pushing/scraping debris from a roof. In one embodiment brush head in diameter is between 1 foot and 4 feet, preferably between 1.5 feet and 3 feet, more preferably between 2 and 3 feet, and more preferably about 2.5 feet.

Different shapes can be used for brush head 20, such as circular, rectangular, square, parallelograms, polygonal, triangular, hexagon, octagon, etc.

Brush head 20 can be solid or have one or more open areas. The one or more open areas can be placed in the geometric center or symmetrically spaced around the geometric center of brush head 20. Brush head 20 can include throwing handles or grips. These throwing handles or grips can be openings in brush head 20 or extend from brush head 20 (such as radially, or from the upper or lower surfaces).

The plurality of projections, fingers, or bristles 40 can be thick or thin, long or short, close together or spaced apart. For example plurality of projections, fingers, or bristles 40 can be spaced similar to the bristles of a broom or spaced apart similar to the tongs of a rake. Spacing of projections, fingers, or bristles 40 can be uniform or non-uniform. For example, spacing can be close at center 105 and spaced apart at perimeter 110. Projections, fingers, or bristles 40 can be straight, angles, or curved in different directions.

Line 60 can be operatively connected to brush head 20 through connection 30. Preferably, swivel 62 is used to pivotally connect line 60 to brush head 20. Swivel 62 can be on line 60 or on brush head 20. Also preferably, connection 30 can include a U-shaped connection allowing line 60 freedom to move around the connection. Connection 30 can be located at various positions on brush head 20, such as center 105, perimeter 110, or anywhere on brush head 20.

Line 60 can be comprised of any material of sufficient strength and durability to withstand wear and tear during use of cleaning brush apparatus. For example, rope, cord, line, string, and chain can be used. In one embodiment a retractable line 60 can be used which automatically retracts for pulling on brush head 20. In one embodiment line 60 can comprise a hose for allowing water spray from brush head 20. In one embodiment line 60 can include a powered retractor (e.g., a winch) which automatically retracts line 60.

Figure 3:
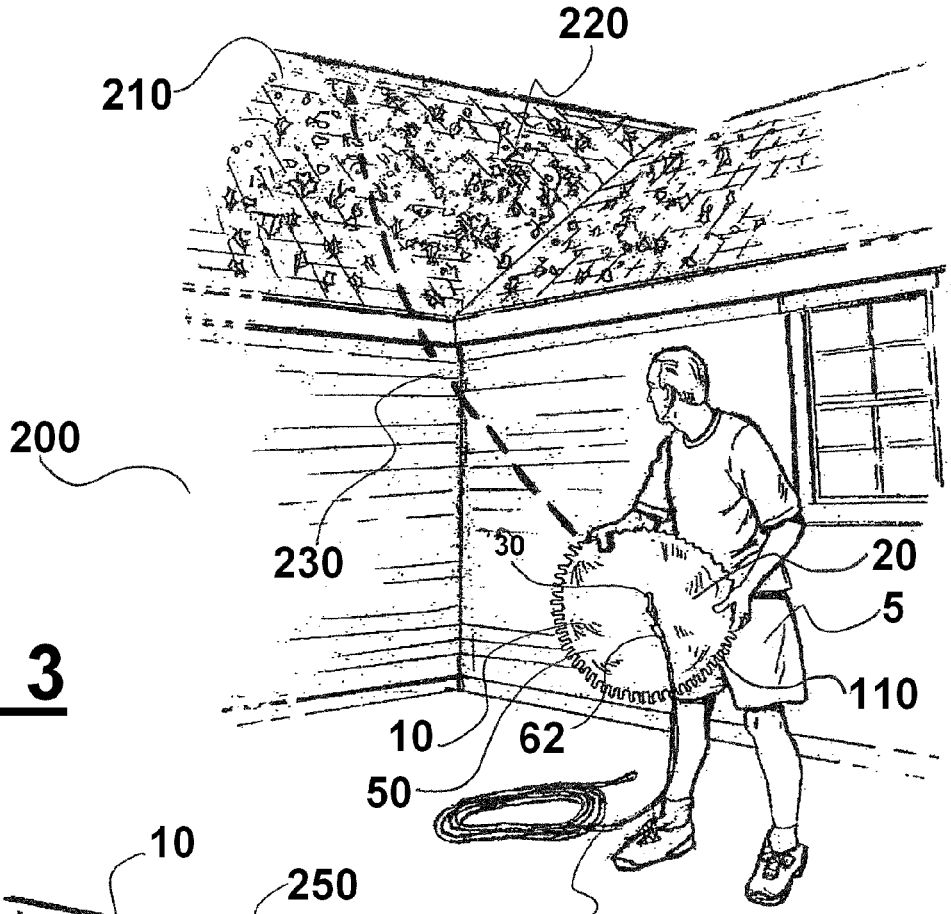
FIG. 3 is a perspective view of an individual placing the roof cleaning brush of FIG. 1 on a roof to be cleaned.
Figure 4:
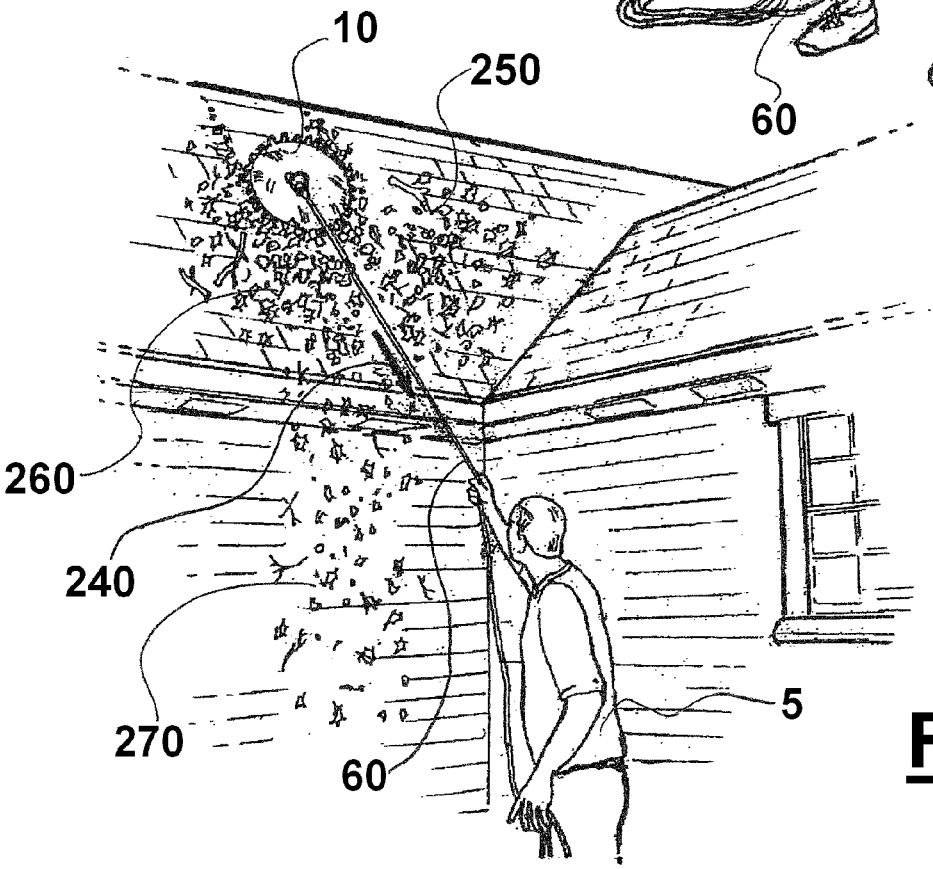
FIG. 4 is a perspective view of an individual cleaning a roof with the roof cleaning brush of FIG. 1.

FIG. 3 is a perspective view of individual 5 placing brush head 20 of roof cleaning brush apparatus 10 on roof 210 to be cleaned. Roof 210 is shown having leaves and other roof debris 220 which must be removed. Arrow 230 shows the path of brush head 20 when landing on roof 210. To place brush head 20 on roof 210, individual 5 tosses brush head 20 like a FRISBEE® type flying saucer, and brush head 20 flies through the air landing on roof 210. FIG. 4 is a perspective view of individual 5 cleaning roof 210 with roof cleaning brush apparatus 10. FIG. 4 shows brush head 20 after it has landed on roof 210 and is being pulled by individual 5 using cord 60. Preferably, individual 5 tosses brush head 20 where it lands close to the top of roof 210. After landing on roof 210 line 60 is pulled in the direction of arrow 240 thereby causing brush head 20 to move in the direction of arrow 240. As brush head 20 is pulled down, leaves and other debris 260 below the path of brush head 20 will be pushed off of roof 210 and fall to the ground. Such falling to the ground is indicated by leaves and other debris 270. After brush head 20 is pulled down from roof 210, it can again be picked up by individual 5 and tossed on roof 210 to another position and pulled to push additional leaves and other debris (e.g., leaves and debris 250) from roof 210. The process is repeated until roof 210 is cleaned to satisfaction.

Figure 5:
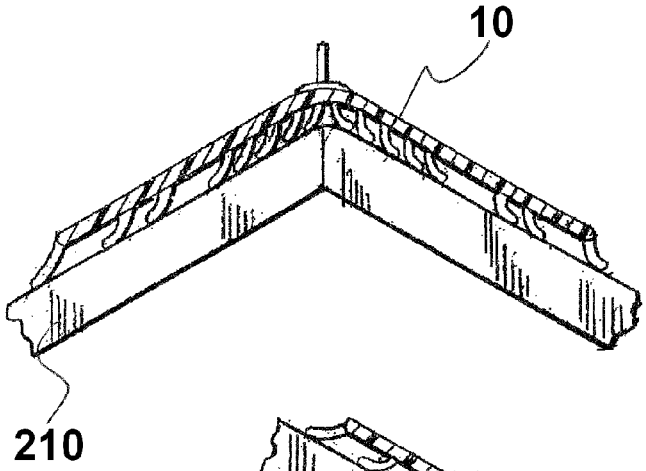
FIG. 5 is a side view of the brush head FIG. 1 over a convex portion of a roof.
Figure 6:
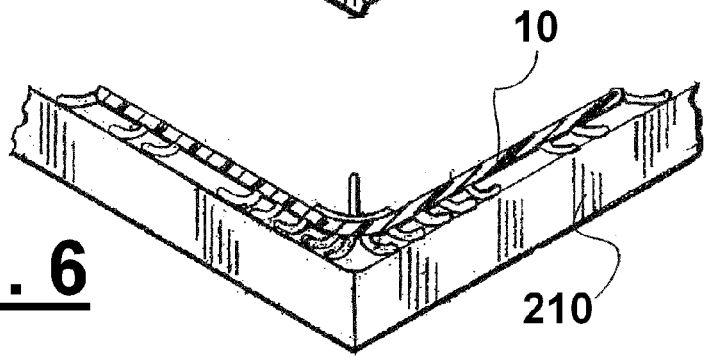
FIG. 6 is a side view of the brush head of FIG. 1 over a concave portion of a roof.

In one embodiment brush head 20 is flexible to conform to changes in shape of roof 210 during the cleaning process. FIG. 5 is a side view of brush head 20 navigating a convex portion of roof 210. FIG. 6 is a side view of brush head 20 navigating a concave portion of roof 210. Regardless of the varying shape of roof 210 brush head 20 can conform to such shape for removing debris therefrom.

Figure 7:
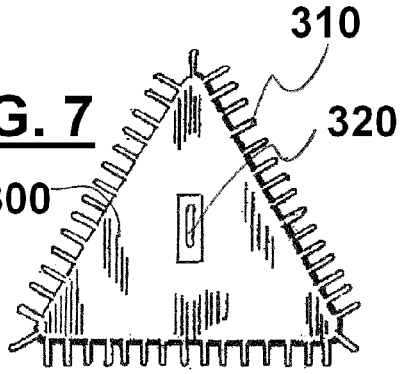
FIG. 7 is a top view of an alternative brush head.

FIG. 7 is a top view of an alternative brush 300. This brush head can be in the shape of a triangle. Brush 300 can comprise connection 320 and plurality of projections, fingers, or bristles 310.

Figure 8:
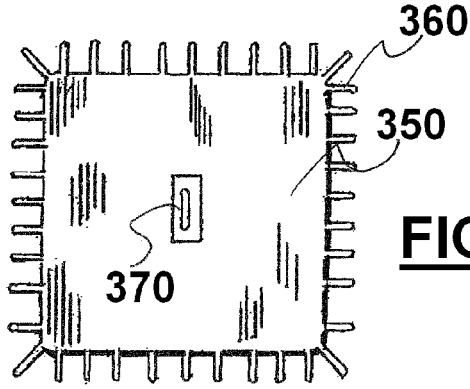
FIG. 8 is a top view of an alternative brush head.

FIG. 8 is a top view of an alternative brush 350. This brush head can be in the shape of a square or rectangle. Brush 350 can comprise connection 370 and plurality of projections, fingers, or bristles 360.

Figure 9:
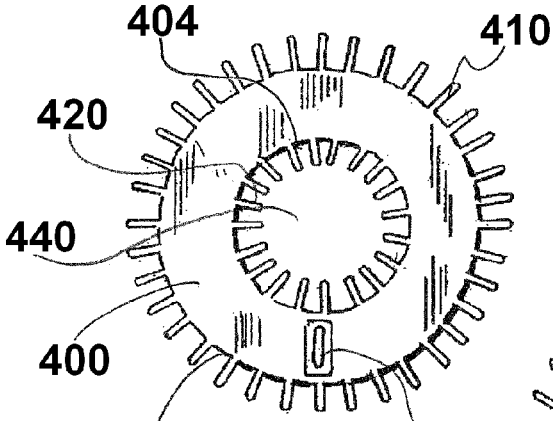
FIG. 9 is a top view of an alternative brush head.

FIG. 9 is a top view of an alternative brush 400. This brush can be in the shape of a ring having opening 440. Brush 400 can comprise connection 430 and plurality of outer projections, fingers, or bristles 410 along with inner projections, fingers, or bristles 420. When tossing brush 400, it can be held either by inner circle 404 or outer circle 402. Connection 430 can be located between inner circle 404 and outer circle 402. This embodiment is believed to have the advantage of being light weight based on the omission of material from inner circle 404. It is also believed to have increased flight performance characteristics compared to a solid circle.

Figure 10:
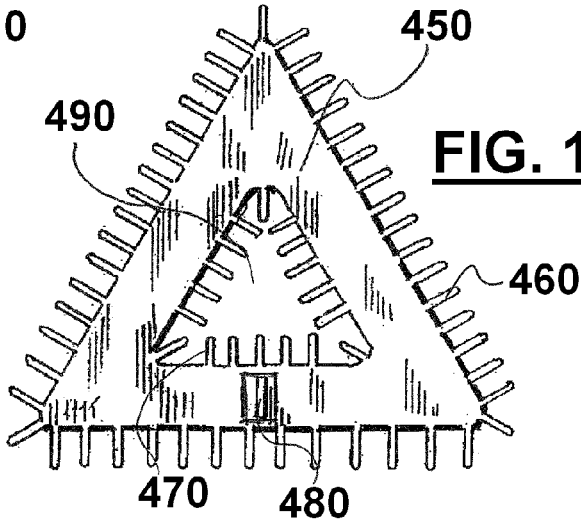
FIG. 10 is a top view of an alternative brush head.

FIG. 10 is a top view of an alternative brush 450. This brush can be in the shape of a triangle having triangular opening 490. Brush 450 can comprise connection 480 and plurality of outer projections, fingers, or bristles 460 along with inner projections, fingers, or bristles 470. When tossing brush 450, it can be held either by inner perimeter 454 or outer perimeter 452. Connection 480 can be located between inner perimeter 454 and outer circle 452 (such as shown between two vertices or at one of the vertices). This embodiment is believed to have the advantage of being light weight based on the omission of material from inner perimeter 454. It is also believed to have increased flight performance characteristics compared to a triangle.

Figure 11:
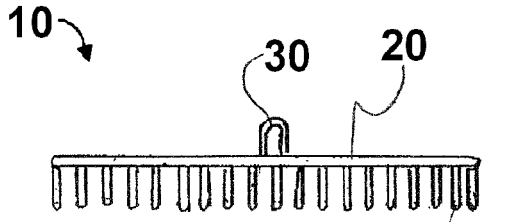
FIG. 11 is a side view of a brush head with uniform bristles or fingers.

FIG. 11 is a side view of brush head 20 with uniformly spaced and sized plurality of projections, fingers, or bristles 40.

Figure 12:
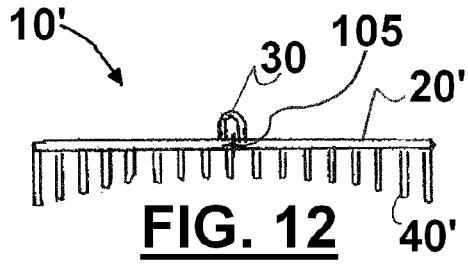
FIG. 12 is a side view of a brush head with bristles or fingers of increasing length when moving toward the perimeter of the brush head.

FIG. 12 is a side view of brush head 20' with uniformly spaced plurality of projections, fingers, or bristles 40'. However, projections, fingers, or bristles increase in length when moving away from geometric center 105.

Figure 13:
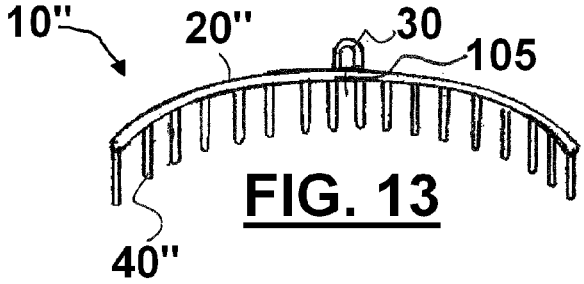
FIG. 13 is a side view of a brush head with a concave head.

FIG. 13 is a side view of brush head 20" with uniformly spaced and sized plurality of projections, fingers, or bristles 40". Looking at brush head 20" from the bottom, it has a concave surface.

Figure 14:
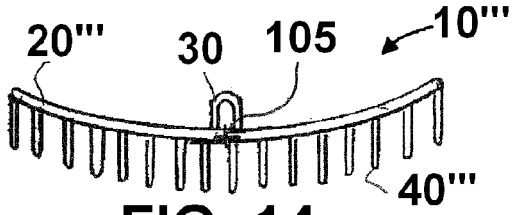
FIG. 14 is a side view of a brush head with a convex head.

FIG. 14 is a side view of brush head 20" with uniformly spaced and sized plurality of projections, fingers, or bristles 40'''. Looking at brush head 20''' from the bottom, it has a convex surface.

Figure 15:
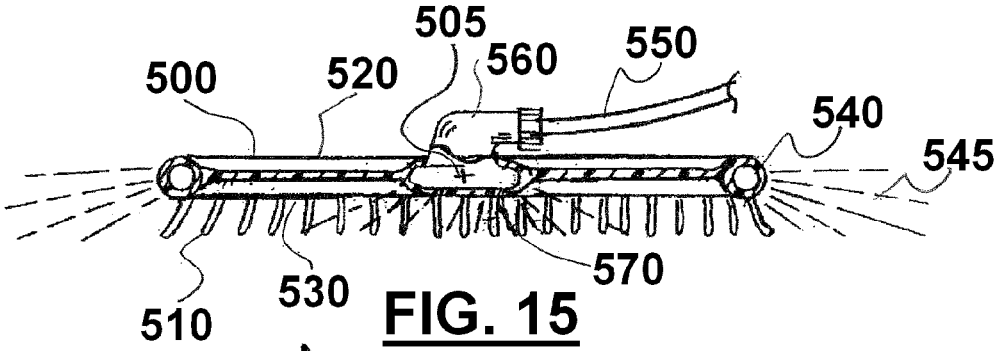
FIG. 15 is a side view of an alternative brush head for spraying water.

FIG. 15 is a side view of an alternative brush head 500 for spraying water. Brush 500 can comprise plurality of projections, fingers, or bristles 510, top 520, bottom 530, line 550, and connection 560. Line 550 can include a hose for fluidly connecting brush 500 to water pressure. Connection 560 can be rotatively connected to brush 500 at geometric center 505. Brush 500 can include outer conduit 540 which can be fluidly connected to connection 560. Water pressure in line 550 can cause inner spray 570 and outer spray 545. Such spraying can assist in removal of small debris such as dirt or grit which would not be picked up by plurality of projections, fingers, or bristles 510. It is preferred that water pressure is turned off until brush head 500 is on roof 210 (to avoid wetting individual 5).

Figure 16:
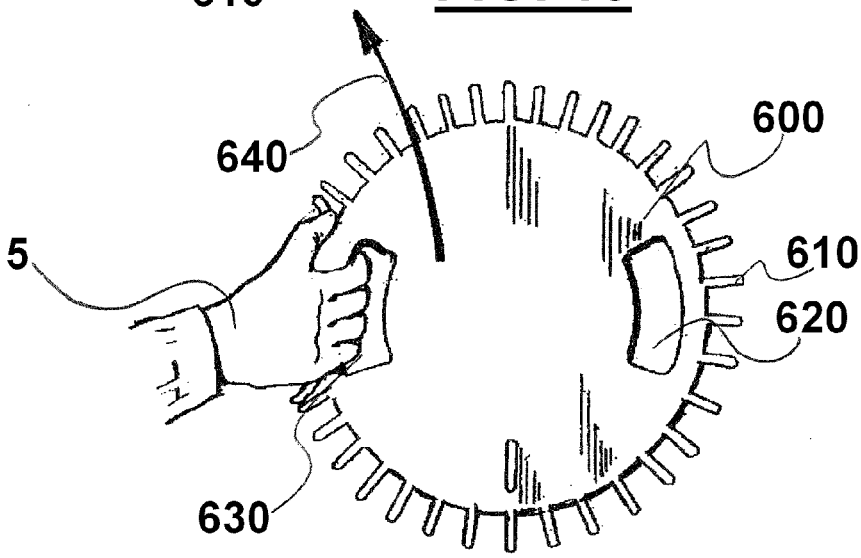
FIG. 16 is a top view of a brush head illustrating one method of throwing the head.

FIG. 16 is a top view of a brush head illustrating one method of throwing brush head 600. In this embodiment brush head 600 can comprise plurality of projections, fingers, or bristles 610, along with opening 620 and opening 630. Openings 620,630 can be used to toss brush head 600. As shown in FIG. 16 individual 5 can grab brush head 600 and toss brush head 600 in the direction of arrow 640. Openings can be used on any shaped brush head.

In one embodiment brush head 20 can include plurality of projections, fingers, or bristles on both its upper and lower surfaces. In this way if brush head 20 lands on roof 210 upside down, it can still be used to remove leaves and other debris. In one embodiment the outer perimeter of brush head 20 can include projections, fingers, or bristles on the upper and lower surfaces. In one embodiment the outer perimeter of brush head 20 can have a circular or elliptical cross section when cut from the upper to the lower surfaces of brush head 20, and this cross section can have projections, fingers, or bristles around its circumference or perimeter.

In one embodiment brush head 20 can have a thickened section at its geometric center 105 which tapers toward its outer perimeter. In one embodiment the outer perimeter of brush head 20 can have a circular or elliptical cross section when cut from the upper to the lower surfaces of brush head 20, and this cross section can have projections, fingers, or bristles around its circumference or perimeter. In one embodiment projections, fingers, or bristles located close to the geometric center 105 can be shorter than projections, fingers, or bristles located close to the circular or elliptical cross sections.

In one embodiment brush head 20 can omit plurality of projections, fingers, or bristles on both its upper and lower surfaces. In one embodiment, projections, fingers, or bristles are located only on the outer perimeter of brush head 20. In one embodiment the plurality of projections, fingers, or bristles are angled away from the geometric center 105 of brush head 20.

The following is a list of reference numerals:

LIST FOR REFERENCE NUMERALS

| (Reference No.) | (Description) |
|---|---|
| 10 | cleaning brush apparatus |
| 20 | brush |
| 25 | circular base |
| 30 | connection |
| 40 | plurality of projections, fingers, or bristles |
| 50 | top of brush |
| 60 | line |
| 62 | swivel |
| 70 | rack |
| 100 | bottom of brush |
| 105 | center |
| 110 | outer perimeter ring of plurality of projections, fingers, or bristles |
| 120 | second outer perimeter ring of plurality of projections, fingers, or bristles |
| 130 | inner plurality of projections, fingers, or bristles |
| 140 | open space |
| 200 | home |
| 210 | roof |
| 220 | leaves and other roof debris |
| 230 | arrow |
| 240 | arrow |
| 250 | leaves and other roof debris |
| 260 | leaves and other roof debris |
| 270 | leaves and other roof debris |
| 300 | brush |
| 310 | plurality of projections, fingers, or bristles |
| 320 | connection |
| 350 | brush |
| 360 | plurality of projections, fingers, or bristles |
| 370 | connection |
| 400 | brush |
| 402 | outer circle |
| 404 | inner circle |
| 410 | outer plurality of projections, fingers, or bristles |
| 420 | inner plurality of projections, fingers, or bristles |
| 430 | connection |
| 440 | opening |
| 450 | brush |
| 452 | outer perimeter |
| 454 | inner perimeter |
| 460 | outer plurality of projections, fingers, or bristles |
| 470 | inner plurality of projections, fingers, or bristles |
| 480 | connection |
| 490 | opening |
| 500 | brush |
| 505 | geometric center |
| 510 | plurality of projections, fingers, or bristles |
| 520 | top |
| 530 | bottom |
| 540 | outer conduit |
| 545 | outer spray |
| 550 | line |
| 560 | connection |
| 570 | inner spray |
| 600 | brush |
| 610 | plurality of projections, fingers, or bristles |
| 620 | opening |
| 630 | opening |
| 640 | arrow |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A method of cleaning a roof of a home, the home being supported on a ground surface and the roof being vertically sloped in relation to the ground surface, the method comprising:

(a) providing a roof brush, the brush including a base capable of flying through air, and a line connected to the base;

(b) while standing on the ground surface tossing the base so that it flies through the air in a flight path, and during the time of the flight path the base remains unsupported by the line, and at the end of the flight path the base landing on a selected position of the roof having leaves or debris to be cleaned;

(c) pulling downwardly on the line to move the base from the landing position of step "b", and causing at least a portion of the leaves or debris to be cleaned off the roof.

2. The method of claim 1, wherein in step "c" the base is pulled off of the roof and falls to the ground surface.

3. The method of claim 2, further comprising the step of tossing a second time the base into the air so that it flies through the air in a second flight path, and during the time of the second flight path the base remains unsupported by the line, and lands on a second selected position of the roof having leaves or debris to be cleaned.

4. The method of claim 2, wherein steps "b" and "c" are repeated until the roof is cleaned of leaves and debris.

5. The method of claim 1, wherein in step "b" during at least part of the flight path the flight path is upwardly curving.

6. The method of claim 1, wherein in step "a" the base includes a plurality of finger type projections.

7. The method of claim 1, wherein in step "a" the base is flexible.

8. The method of claim 1, wherein in step "a" the base has a disc shape with a diameter and a thickness, the diameter being much greater than the thickness.

9. The method of claim 1, wherein in step "a" the base is operatively connected to a water pressure supply and water can be sprayed from the base.

10. The method of claim 1, wherein in step "a" the line is selected from the group consisting of rope, cord, string, and chain.

11. The method of claim 1, wherein in step "b" during the flight the base is sustained in flight by aerodynamic reaction forces.

12. The method of claim 1, wherein in step "a" the base has a shape selected from the group consisting of triangular, square, or rectangular.

13. The method of claim 1, wherein in step "a" the base has a perimeter with an interior, the perimeter having a shape and at least one opening located in the interior having an interior shape, the interior shape being the same as the perimeter shape.

14. The method of claim 1, wherein in step "a" the base has a perimeter with an interior, and a plurality of openings located in the interior.

15. A method of cleaning a roof, the method comprising:

(a) providing a roof brush, the brush including a base capable of flying through air, and a line connected to the base;

(b) causing the base to fly through the air in a flight path, wherein during the flight path aerodynamic reaction forces between the base and the air sustain the base in its flight, and at the end of the flight path the base landing on a selected position of a roof having leaves or debris to be cleaned;

(c) pulling on the line and causing the base and at least a portion of the leaves or debris to be cleaned to fall off of the roof.

16. The method of claim 15, wherein in step "a" the line is selected from the group consisting of rope, cord, string, and chain.

17. The method of claim 15, wherein in step "b" a spinning motion is imparted to the base during the flight path.

18. A method of cleaning a roof, the method comprising:

(a) providing a roof brush, the brush including a base and a line, the line being connected to the base;

(b) tossing the base so that it glides or flies through the air in a flight path, and during the flight path the base supports at least a portion of the line;

(c) at the end of the flight path the base lands on a position of a roof having leaves or debris to be cleaned; and (d) pulling on the line to causing the base and at least a portion of the leaves or debris to be cleaned to fall off of the roof.

19. The method of claim 18, wherein in step "a" the line is selected from the group consisting of rope, cord, string, and chain.

20. The method of claim 18, wherein in step "b" a spinning motion is imparted to the base during the flight path.

* * * * *